US005945066A

United States Patent [19]

Griffin et al.

[11] Patent Number: 5,945,066

[45] Date of Patent: Aug. 31, 1999

[54] ZINC-COPPER BASED ALLOY AND CASTINGS MADE THEREFROM

[76] Inventors: James D. Griffin, 1455 Rochester Rd., Oakland, Mich. 48363; David A. Griffin, 35195 Dearing, Sterling Heights, Mich. 48312; Michael H. Griffin, 5335 Boardman, Dryden, Mich. 48428

[21] Appl. No.: 09/000,753

[22] Filed: Dec. 30, 1997

Related U.S. Application Data

[60] Provisional application No. 60/066,270, Nov. 20, 1997.

[51] Int. Cl.[6] ..... C22C 18/02

[52] U.S. Cl. ..... 420/516; 420/478; 420/587

[58] Field of Search ..... 420/478, 516, 420/587

[56] References Cited

U.S. PATENT DOCUMENTS

| | | | |
|---|---|---|---|
| 933,433 | 9/1909 | Guggenbuhl | 420/515 |
| 1,490,696 | 4/1924 | DeGolyer | 420/515 |
| 1,815,479 | 7/1931 | Morell | 314/20 |
| 1,832,992 | 11/1931 | Lorang | 420/515 |
| 1,850,986 | 3/1932 | Schroeder et al. | 112/235 |
| 2,909,429 | 10/1959 | Thomson et al. | 420/516 |
| 3,037,859 | 6/1962 | Larrieu | 420/516 |
| 3,420,661 | 1/1969 | Larrieu | 420/516 |
| 3,567,436 | 3/1971 | Takehiro et al. | 420/516 |
| 3,615,379 | 10/1971 | Pelzel | 420/515 |
| 3,679,404 | 7/1972 | Larrieu | 420/515 |
| 3,720,510 | 3/1973 | Isobe et al. | 420/516 |
| 3,847,556 | 11/1974 | Gervais et al. | 428/582 |
| 3,850,622 | 11/1974 | Balliett | 420/516 |
| 4,126,450 | 11/1978 | Lathrop et al. | 420/516 |
| 4,863,686 | 9/1989 | Yamamoto et al. | 420/516 |
| 4,882,126 | 11/1989 | Okada et al. | 420/514 |
| 4,990,310 | 2/1991 | Rashid et al. | 420/514 |
| 5,223,051 | 6/1993 | Ryntz, Jr. | 148/538 |

FOREIGN PATENT DOCUMENTS

| | | |
|---|---|---|
| 3828397 | 3/1989 | Germany . |
| 62287030 | 12/1987 | Japan . |
| 1294837 | 11/1989 | Japan . |
| 5084591 | 4/1993 | Japan . |
| 5195121 | 8/1993 | Japan . |
| 7278707 | 10/1995 | Japan . |

*Primary Examiner*—Sikyin Ip
*Attorney, Agent, or Firm*—Lynn E. Cargill

[57] ABSTRACT

A Zn—Cu based alloy is disclosed including from about 11 to about 50 wt. % of Cu, from about 0.1 to about 10 wt. % of Al, from about 0.01 to about 1.0 wt. % of Mg, and from about 0.001 to about 0.1 wt. % of at least one member of the group consisting of Ti, Pb, Sn, Cd, Ni, Mn, Cr, Fe and mixtures thereof; and the balance being Zn. The Ti component may be added via an Al—Ti alloy. This alloy yields high-part-number castings especially useful in the automotive parts field.

6 Claims, No Drawings

ZINC-COPPER BASED ALLOY AND CASTINGS MADE THEREFROM

This application claims the benefit of U.S. Provisional Application No.: 60/066,270 filing date Nov. 20, 1997.

TECHNOLOGICAL FIELD

This invention relates to rapid tooling alloys for use in moldings, castings, and stampings, and more particularly to a zinc-copper based alloy for manufacturing articles.

BACKGROUND OF THE INVENTION

All aspects of manufacturing are striving to reduce the time between concept and finished product. Conventional methods of manufacture includes the steps of design, clay models, making of a prototype mold, followed by a short run of manufactured articles, and finally the production of a stainless steel mold, casting or stamping for production utilized to produce a large number of finished products.

Traditionally, in the manufacture of automotive parts, a prototype mold or stamping is made of a zinc-based alloy, such as zinc-based alloy KIRKSITE. Generally these molds or stampings yield about one thousand to six thousand parts before the mold or stamping loses its efficacy. After several thousand parts are either molded or stamped on such a prototype molding or stamping, the last parts being manufactured are no longer within specifications. Consequently, as the tolerances are no longer being met, the prototype mold becomes useless, as repairing the casting or mold is not feasible. The forming edges usually become dull with use. Generally, these prototype molds are not recyclable, rendering the entire used mold useless. After the prototype mold or stamping has been used up, at a cost of from about $500 to about $20,000, a production molding or stamping from steel would be made.

The production molds or stampings have a much greater cost, from about $2,000 to $500,000, depending on the size of the part being manufactured, the number of cavities in the mold, along with other considerations. These production molds can take weeks or months to make. This litany of steps has made the lead time between design and production last up to two years or more.

In the automotive industry, it is desirable to shorten the lead time. One way to do this is to shorten the time that is required to make the molds or stampings, or, to eliminate one of the steps altogether. The automotive companies want to reduce the time between design and production to less than ninety days. By using new technology, they have eliminated certain steps including the clay model making step with CAD-CAM computer systems in communication with CNC grinders, which cut out the moldings or stampings.

The next logical step for shortening the lead time between design and production would be to prolong the usefulness of the prototype mold beyond the initial parts that it is capable of making. As most car parts require runs of up to 200,000 parts, new materials are needed for the molds or stamps in order to add durability. The necessary properties for such a new material would include a high compressive and tensile strengths, as well as other durability properties. In addition, the new material must be pourable, castable and machinable. Previous attempts to make such a new material have yielded Zn—Cu—Al alloys which exhibit Birnell hardnesses of about 50–75, while production steel molds and stampings exhibit hardnesses beyond the Birnell scale (generally less than 150), with their actual hardness values extend into the "B" scale (generally more than 150 on the Birnell hardness scale).

Therefore, it would be a real advantage to provide a new material which would exhibit these properties, while still being pourable, castable, and machinable, as well as castings made therefrom.

SUMMARY OF THE INVENTION

The present invention achieves this advantage by disclosing and providing a new zinc-copper-based alloy with certain additives, the alloy being novel and distinct over the prior art because it exhibits a much greater hardness than prior art alloys, while still being pourable, castable, and machinable. Useful additives to the zinc-copper base material include Al and Mg along with Ti, Pb, Sn, Cd, Si, Ni, Mn, Cr, Fe and mixtures thereof. These additives are incorporated in relatively smaller amounts than the Zn—Cu base material. The castings made from this new alloy are capable of being used as extended life prototype molds, castings and stampings which can produce from about 50,000 to 200,000 parts without replacement.

The disclosed zinc-copper based alloy includes from about 11 to about 50 weight percent of copper, about 0.1 to about 10 weight percent of aluminum, about 0.01 to 1.0 weight percent of magnesium, along with about 0.001 to 1.0 weight percent of at least one of the following elements: Ti, Pb, Sn, Cd, Si, Ni, Mn, Cr, Fe and mixtures thereof, with the balance being Zn, the weight percentages being based upon the resultant alloy weight. Although each additive gives certain new properties, titanium has been found to be especially effective for adding compression resistance, one of the most important properties.

A preferred zinc-copper based alloy includes from about 11 to about 18 wt. % of Cu, from about 3 to about 4 wt. % of Al, from about 0.02–0.05 wt. % of Mg, from about 0.01–0.05 wt. % of Ti, and the balance being Zn.

Another preferred alloy of the present invention includes from about 15 to about 18 wt. % of Cu, from about 3 to about 4 wt. % of Al, from about 0.02 to about 0.05 wt. % of Mg, from about 0.01 to about 0.1 wt. % of Ti, less than 0.01 wt. % of a member selected from the group consisting of Pb, Sn, Cd and mixtures thereof, and less than 0.05 wt. % of at least one member selected from the group consisting of Si, Ni, Mn, Cr, Fe, and mixtures thereof, with the balance being Zn.

The titanium can be either be added elementally or as an alloy, especially an aluminum-titanium alloy. The above stated percentages remain constant regardless of how the titanium is added to the alloy.

Castings, moldings and stampings made from the alloy may include sandcastings, sheet metal forming dies, metal molds for stamping, plastic molding dies, die castings, and dies and molds for injection molding.

Other features and advantages of the present invention will be readily appreciated as the same becomes better understood after reading the subsequent detailed description of the invention.

DETAILED DESCRIPTION OF THE INVENTION

In accordance with a preferred embodiment of the invention, disclosed is an alloy based upon zinc and copper, along with aluminum and magnesium and other additives, that exhibits certain desirable properties conducive to extended life prototype molds, castings and stampings, including compressive strength, tensile strength, and shear strength. Additives to achieve these properties include Ti, Pb, Sn, Cd, Si, Ni, Mn, Cr, Fe and mixtures thereof.

Of these properties, the compression strength is one of the most important for extended life. The tests performed on various alloys in accordance with the present invention have all yielded compression strengths of greater than 70,000 pounds. In accordance with a preferred embodiment of the present invention, the Zn—Cu—Al—Mg—Ti alloy compression tested at over 80,000 pounds. Rockwell testing showed hardnesses on the "B" scale, with values of between 149 and 152. The closest prior art we know about has a hardness of 105–115. The materials of the present invention have all yielded hardnesses on the "B" scale, i.e. having hardnesses greater than 150. Not only does the alloy of the present invention exhibit a high hardness, it also exhibits extreme wear resistance.

Experiments were performed by first applying WC, TiC, $Si_3N_4$, and other ceramics and cermets into the mold before casting our material. The resulting castings were found to have hardnesses on the "C" scale. The ceramic hardeners became an integral "skin" on top of our casting, leaving the actual working surface coated with the special hardener. Other surface treatments are envisioned which can either be attached to the working surface of the casting, molded right onto the surface, or surface treated after casting, such as quenching, annealing or other heat/pressure/gas treatments.

Without limiting the scope of the invention, examples of the invention are given hereinbelow.

EXAMPLES

Example I

By the following method, a Zn—Cu—Al—Mg alloy was made including Ti, Si, Mn, and Cr additives. In a heat combustion chamber, the temperature was elevated to 1,000° F. One half of the total needed amount, based upon the desired resultant alloy, of SHG (special high-grade) zinc slabs, with a purity of 99.995% zinc was charged into a cast-iron pot in the heat combustion chamber. The zinc slabs were melted. In addition, one half of the total amount, based upon the desirable resultant alloy, of pure copper chops and all of the required aluminum was charged into the zinc-containing cast iron pot, creating a bath. The aluminum used was 6061 aluminum alloy, available from Arco Alloy Company of Detroit, Mich. (6061 aluminum alloy is an alloy having 0.15 pbw Ti, 0.4 pbw Si, 0.15 to 0.4 pbw Cu, 0.15 pbw Mn, 0.8–1.2 pbw Mg, and 0.04 pbw Cr, balance of aluminum). The remainder of the 99.995% zinc was then charged into the cast-iron pot and melted. The bath temperature was then brought up to 1100° F., and mixed until all the in-bath copper went into solution. Thereafter, the remaining balance of the copper was charged into the cast iron pot and again mixed until all the copper was in solution. Using a zinc flux to decrease surface tension, the dross was skimmed off and a sample was taken using ASM methods. Test method ASTM-E 607-90 was used and a sample was analyzed with a spectrograph. The composition and property values of the resulting material is found on Table I.

Example II

The same mixing procedure was utilized as in Example I, except we raised the copper, aluminum, magnesium and titanium concentrations, and other additives, including chromium and silicon were added. The experimental results are listed in Table I. As can be seen, the results were very favorable.

Example III

Again, the procedure of Example I was repeated, but with a higher copper, magnesium and titanium concentration, although the aluminum content was decreased. Iron was presented in this Example, and the test results are shown in Table I. The properties displayed are very desirable.

TABLE 1

| Example | Zn % by wt. | Cu % by wt. | Al % by wt. | Mg % by wt. | Additives | Birnell Hardness |
|---|---|---|---|---|---|---|
| Example I | bal. | 13.64 | 2.7 | 0.002 | Ti 0.001.; Sn 0.004 Cd 0.001; Fe 0.03 Pb 0.006 | 182 |
| Example II | 74.36 | 18.00 | 3.90 | 0.003 | Ti 0.004; Pb 0.001; Cr 0.005; Si 0.005; Mn 0.005; Cd 0.001;. Ni 0.005; Sn 0.001 | 182–187 |
| Example III | bal. | 27.15 | 1.92 | 0.005 | Fe 0.20; Ni 0.005 Sn 0.005; Ti 0.005; Pb 0.002 | "C" 30–40 |

While the above Examples are illustrative of the present invention, and the compositions detailed therein, they are not to limit the scope of the invention. The limitations of the scope of the invention are found in the appended claims.

What is claimed is:

1. A Zn—Cu based alloy, consisting of:

from about 11 to about 50 wt. % of Cu;

from about 0.1 to about 10 wt. % of Al;

from about 0.01 to about 1.0 wt. % of Mg;

from about 0.001 to about 0.1 wt. % of Cr; and from about 0.001 to about 0.1 wt. % of at least one member selected from the group consisting of Ti, Pb, Sn, Cd, Si, Ni, Mn, Fe and mixtures thereof;

and the balance being Zn.

2. A casting made from the alloy of claim 1, said casting being selected from the group consisting of sand castings, sheet metal forming dies, metal molds for stampings, plastic molding dies, die castings, and molds for injection molding.

3. A Zn—Cu based alloy, consisting of:

from about 11 to about 50 wt. % of Cu;

from about 0.1 to about 10 wt. % of Al;

from about 0.01 to about 1.0 wt. % of Mg;

from about 0.001 to about 0.1 wt. % of Cr;

from about 0.001 to about 0.1 wt. % of Ti;

less than 0.01 wt. % of each of the elements, Pb, Sn, and Cd;

less than 0.05 wt. % of each of the elements, Si, Ni, Mn, and Fe;

with the balance being Zn.

4. A Zn—Cu based alloy, consisting of:

13.64 wt. % Cu;

2.7 wt. % Al;

0.002 wt. % Mg;

0.001 wt. % Ti;

0.004 wt. % Sn;

0.001 wt. % Cd;

0.03 wt. % Fe;

0.006 wt. % Pb; and the balance being Zn.

5. A Zn—Cu based alloy, consisting of:

18 parts by weight Cu;

3.9 parts by weight Al;

0.003 parts by weight Mg;

0.004 parts by weight Ti;
0.001 parts by weight Pb;
0.005 parts by weight Cr;
0.005 parts by weight Si;
0.005 parts by weight Mn;
0.001 parts by weight Cd;
0.005 parts by weight Ni;
0.001 parts by weight Sn;
and 74.36 parts by weight Zn.

6. A Zn—Cu based alloy, consisting of:
27.15 wt. % Cu;
1.92 wt. % Al;
0.005 wt. % Mg;
0.20 wt. % Fe;
0.005 wt. % Ni;
0.005 wt. % Sn;
0.005 wt. % Ti;
0.002 wt. % Pb; and
the balance being Zn.

* * * * *